US005743417A

United States Patent [19]

Mathis

[11] Patent Number: 5,743,417

[45] Date of Patent: Apr. 28, 1998

[54] IRONING BOARD CADDY

[76] Inventor: S. Kent Mathis, 1070 Mattison, Conway, Ark. 72032

[21] Appl. No.: 698,502

[22] Filed: Aug. 15, 1996

[51] Int. Cl.[6] ..... A47F 5/08

[52] U.S. Cl. ..... 211/119; 36/106

[58] Field of Search ..... 211/119, 181, 211/51; 34/106, 104; 36/107, 142

[56] References Cited

U.S. PATENT DOCUMENTS

| | | | |
|---|---|---|---|
| D. 236,414 | 8/1975 | Kroll | D7/95 |
| 768,364 | 8/1904 | Hines . | |
| 920,049 | 4/1909 | Good . | |
| 1,024,720 | 4/1912 | Cottle . | |
| 1,483,592 | 2/1924 | Pelstring . | |
| 1,963,977 | 6/1934 | Flagstad | 68/10 |
| 2,241,084 | 5/1941 | Dobbins | 38/141 |
| 2,278,401 | 3/1942 | Micari | 224/5 |
| 2,618,419 | 11/1952 | Vanish | 224/5 |
| 2,635,779 | 4/1953 | Pfeiffer | 220/17 |
| 2,796,994 | 6/1957 | Saltness | 211/86 |
| 2,831,598 | 4/1958 | Slavsky et al. | 220/18 |
| 2,884,722 | 5/1959 | Lehrman | 38/140 |
| 2,944,673 | 7/1960 | Geluso | 211/86 |
| 3,055,129 | 9/1962 | Selleck | 38/107 |
| 3,121,388 | 2/1964 | Benson | 101/415.1 |
| 3,159,894 | 12/1964 | Haug | 24/252 |
| 3,248,765 | 5/1966 | Achabal et al. | 24/81 |
| 3,417,443 | 12/1968 | Gentilucci | 24/81 |
| 3,534,865 | 10/1970 | Holliman | 211/86 |
| 3,913,878 | 10/1975 | Wayne | 38/104 |
| 3,990,617 | 11/1976 | Carter | 224/5 H |
| 3,995,744 | 12/1976 | Metcalf | 211/131 |
| 4,154,010 | 5/1979 | Evans | 38/106 |
| 4,425,942 | 1/1984 | Hage et al. | 138/38 |
| 4,535,921 | 8/1985 | Sanders | 223/106 |
| 5,180,067 | 1/1993 | Conaway et al. | 211/119 |
| 5,181,621 | 1/1993 | Plaehn | 211/181 |
| 5,249,702 | 10/1993 | Topp et al. | 220/705 |
| 5,255,401 | 10/1993 | Sambrookes et al. | 4/605 |
| 5,272,825 | 12/1993 | Simpson | 38/137 |
| 5,379,536 | 1/1995 | Lorenzana | 38/106 |

OTHER PUBLICATIONS

Household Organizers Catalog, Grayline, Carol Stream, III, 1996, pp. 8, 14, 16, 17.

Official Gazette, published patent application B 390,732, pp. 1537–1538 (Jan. 28, 1975).

*Primary Examiner*—Peter M. Cuomo
*Assistant Examiner*—Gerald A. Anderson
*Attorney, Agent, or Firm*—Ray F. Cox, Jr.

[57] ABSTRACT

An ironing board caddy for stowing ironing supplies and accessories. The caddy removably attaches to an ironing board so that the supplies and accessories are kept conveniently to hand during clothes ironing. The ironing board caddy is conveniently a wire form construction with a hanging member adapted to serve three functions: first, it is shaped to fit over the end of the ironing board to serve as a means of attachment of the caddy to the ironing board; second, it serves as a carrying handle when it is being moved from the ironing board to a storage place and vice versa; and finally, it serves as a wall hanger when the caddy is stored between uses. The caddy also has a basket member suspended from the hanging member to receive ironing supplies and accessories such as sprays, water bottles, and the like.

8 Claims, 3 Drawing Sheets

32
20

33
31
30
34
33
32
44
41
34
46
42
51
48
49
43
45
40
50
47

20
30
34
51
50
40

20
30
33
34
34
33
40
50
51

IRONING BOARD CADDY

BACKGROUND OF THE INVENTION

The present invention relates to clothes ironing and specifically to an attachment to an ironing board which holds various supplies and accessories used in the ironing process in a convenient and accessible manner.

In modern practice, clothes ironing employs various supplies and accessory products to aid in the ironing process; for example, spray starch, distilled water for replenishing the water supply of steam irons, or water sprays. It is desirable that these supplies and accessory products be kept conveniently near to hand while ironing. Various attempts have been made to provide for devices that attach to ironing boards and provided storage or supporting functions to aid in the ironing process.

A number of patents relate to devices that attach or mount to ironing boards and support clothing. These devices often provide for a hook or loop to attach the support to the ironing board. An example is U.S. Pat. No. 2,241,084 issued to Dobbins on May 6, 1941. Dobbins discloses a device with a U-shaped loop for placement over the edge of the ironing board. Similar arrangements are disclosed in U.S. Pat. No. 2,796,994 and U.S. Pat. No. 2,944,673. U.S. Pat. No. 3,534,865 issued to Holliman on Oct. 20, 1970 also discloses such a loop type attachment with the added feature that the clothes are hung outboard on an inclined support so that the weight of the clothes bears against the loop attachments and thereby bears more firmly against the ironing board.

Various patents have also been granted to devices that attach to ironing boards with the specific purpose of holding supplies or accessory items rather than clothing. U.S. Pat. No. 2,884,722 discloses an ironing board cover with an attached pouch for holding ironing accessories. U.S. Pat. No. 4,154,010 issued to Evans on May 15, 1979 discloses a removable ironing board attachment which provides multiple storage compartments. The Evans device sits on top of the ironing board and is held thereon by L-shaped brackets that fit around the edge of the ironing board. A caddy that sits on top of the ironing board is undesirable since it interferes with ironing. Similarly, U.S. Pat. No. 920,049 discloses a "Combined Waxing Pad and Iron Holder"which sits on top of the ironing board and is held in place by a pair of wire brackets which are bent around opposite edges of the ironing board. A different method of attachment is disclosed in U.S. Pat. No. 4,535,921 issued to Sanders on Aug. 20, 1985. Sanders discloses a caddy with compartments for holding various ironing accessories. The caddy is attached to the edge of the ironing board with a spring clip. Published patent application No. B 390,732 of Wayne discloses the attachment of a device to an ironing board with a C-shaped screw clamp. By contrast, U.S. Pat. No. 3,055,129 discloses a support attachment for an ironing board which acts as a permanent extension to the ironing board.

U.S. Pat. No. 5,379,536 issued to Lorenzana on Jan. 10, 1995 for "Ironing Board Attachment Including Basket" discloses a detachably mounted ironing board attachment mounted to an ironing board with a pressing member attached to a pivotally mounted basket.

The various attempts to solve the problem of conveniently stowing ironing supplies and accessories have been less than completely successful for a number of reasons. One problem is what to do with the caddy when the ironing is completed. One solution as mentioned above is to make the caddy part of the ironing board. For other types of removable caddies no solution is readily available. It is desirable that the caddy be carried as easily as it is disposed on the ironing board. It is also desirable that the caddy be easily stowed between uses. As to the first point, it is known in unrelated arts to provide caddies with handles for carrying; for example, U.S. Pat. No. 768,364 issued to Hines on Aug. 23, 1904 for "Painter's Appliance" discloses a caddy for painter's supplies which is equipped with a carrying handle. The problem is how to configure a carrying handle that is compatible with the need to attach the caddy to the ironing board. As to the second problem, various caddies from unrelated arts are provided with hangers to suspend a caddy from a vertical surface. For example, shower caddies are known that are suspended from a shower head, such as U.S. Pat. No. 5,255,401. Such devices are not however adaptable to being suspended from a horizontal surface.

These and other problems and limitations of the prior art are overcome by the present invention as summarized below.

SUMMARY OF THE INVENTION

The present invention is a caddy for stowing ironing supplies and accessories. The caddy removably attaches to an ironing board so that the supplies and accessories are kept conveniently to hand during clothes ironing.

The ironing board caddy of the present invention is conveniently a wire form construction with a hanging member adapted to serve three functions: first, it is shaped to fit over the end of the ironing board to serve as a means of attachment of the caddy to the ironing board; second, it serves as a carrying handle when it is being moved from the ironing board to a storage place and vice versa; and finally, it serves as a wall hanger when the caddy is stored between uses. The caddy also has a basket member suspended from the hanging member to receive ironing supplies and accessories such as sprays, water bottles, and the like. Since the caddy of the present invention is suspended from the end of the ironing board, the supplies and accessories are kept conveniently to hand but do not interfere with the ironing itself. No part of the caddy interferes with the top surface of the ironing board since the only portion of the caddy which lies on the top of the ironing board is a single wire comprising the topmost part of the hanging member. Furthermore, the caddy does not project out away from the ironing board but hangs beneath the top of the iron board unlike examples in the prior art which project out from the top of the ironing board and which can therefore interfere with ironing even though the top of the ironing board itself is substantially clear of most parts of the ironing board caddy.

The ironing board caddy of the present invention is as noted above desirably of a wire form construction which lends itself to economical construction, durability, and aesthetic appeal.

It is therefore an object of the present invention to provide for an ironing board caddy which is easily carried, stored and attached to an ironing board.

A further object of the present invention is to provide for an ironing board caddy which does not interfere with ironing while stowing ironing supplies and accessories in an easily accessible manner.

An additional object of the present invention is to provide for an ironing board caddy which is economical, durable, and aesthetic in appearance.

Further objects and advantages of the present invention will be apparent from a consideration of the following detailed description of the preferred embodiments in conjunction with the appended drawings as briefly described following.

DETAILED DESCRIPTION OF THE PREFERRED EMBODIMENTS

Figure 1:
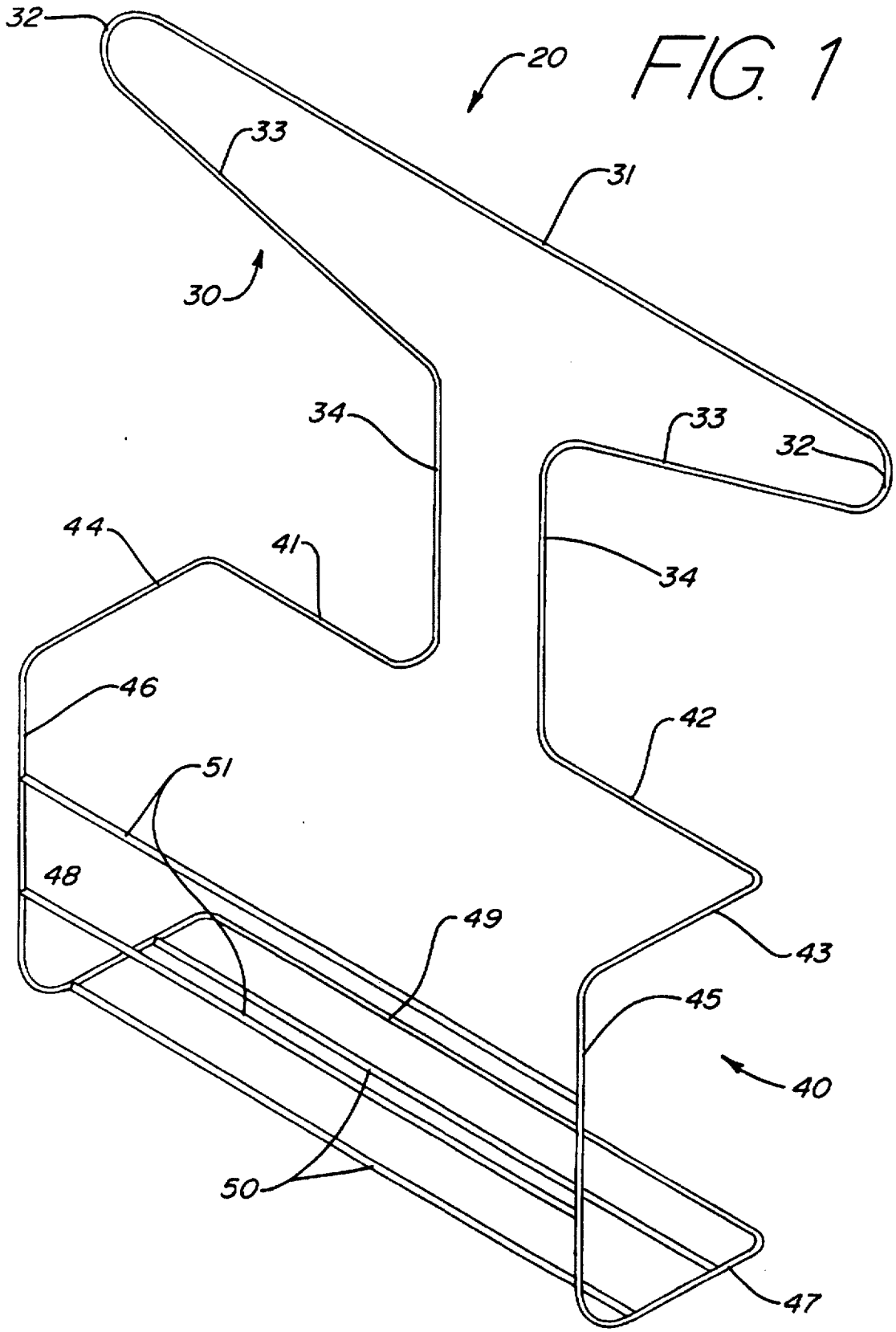
FIG. 1 is a perspective view of the ironing board caddy.
Figure 2:
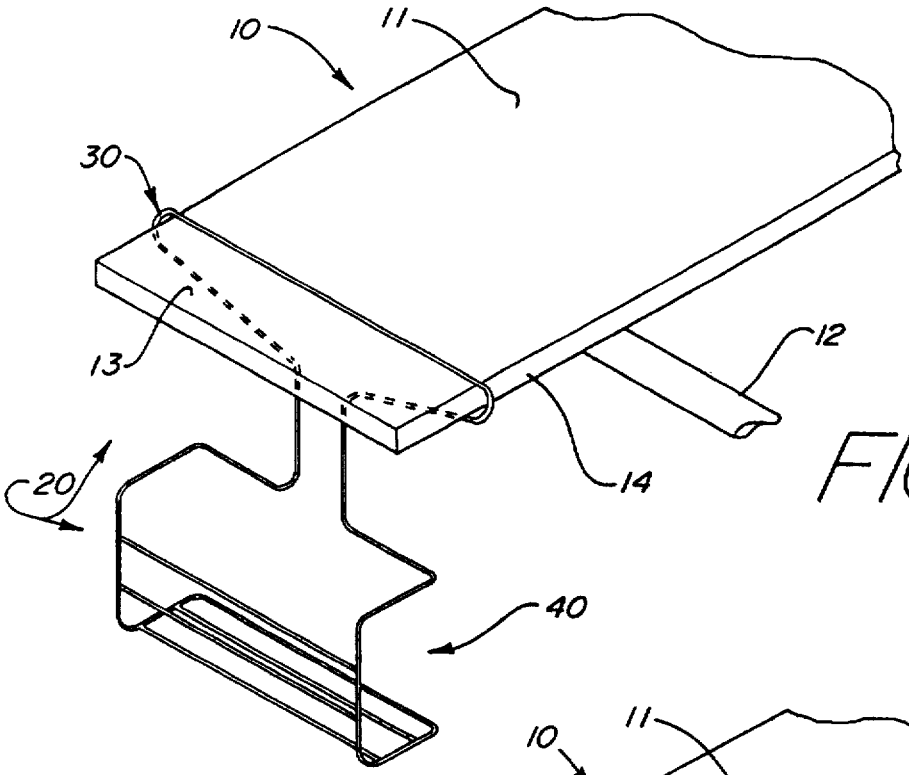
FIG. 2 is a perspective view of the ironing board caddy deployed for use on an ironing board.
Figure 3:
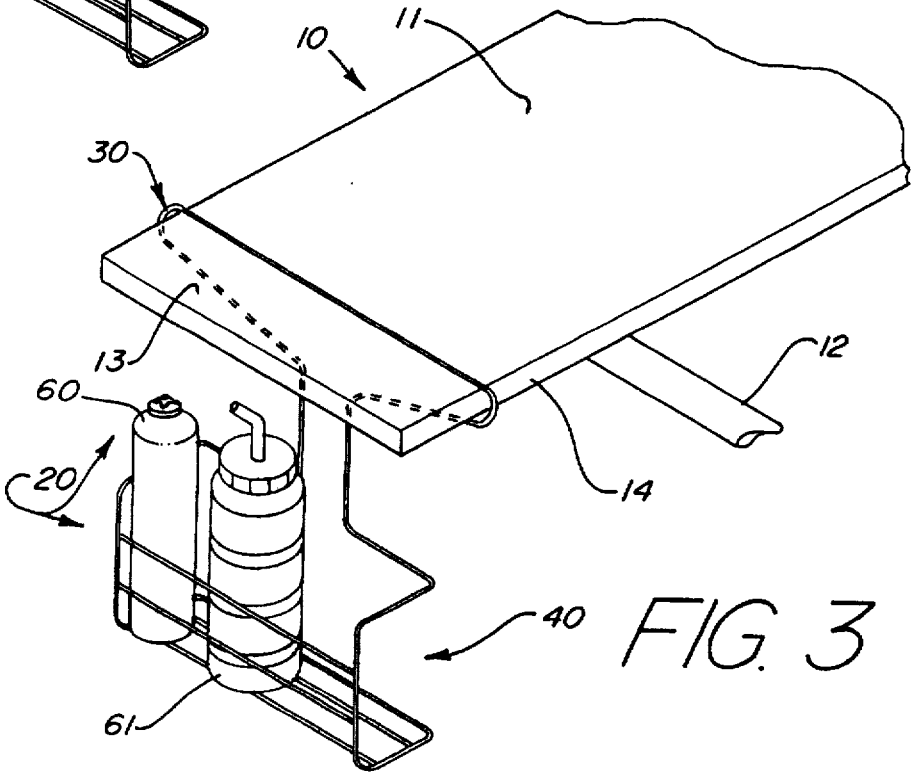
FIG 3. is the perspective view of FIG. 2 additionally showing various ironing supplies and accessories in the ironing board caddy.
Figures 4, 5:
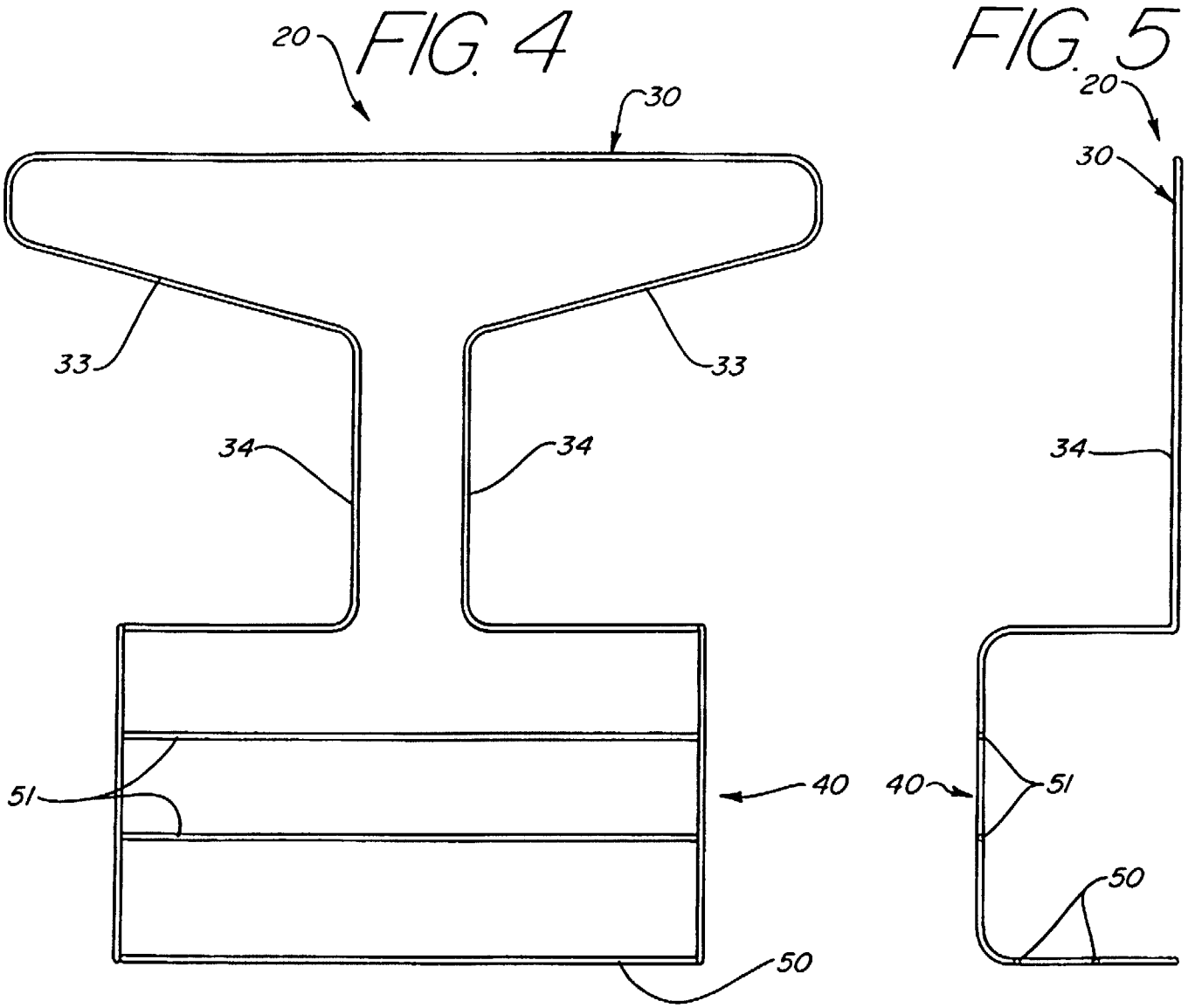
FIG. 4 is a front elevation view of the ironing board caddy.
FIG. 5 is a right side elevation view of the ironing board caddy.

The present invention may be described with reference to FIGS. 1–5. The ironing board caddy 20 of the present invention is used in conjunction with an ironing board 10 of the typical domestic type having an essentially flat top surface 11 for placing clothing for ironing, a pair of sides 14 (only one side 14 visible in FIGS. 2 and 3) defining the width and thickness of the ironing board 10, and a bottom (not shown) to which folding legs 12 are attached. The ironing board 10 is designed for ease of storage through the provision of the folding legs 12 (partially shown in FIGS. 2 and 3). While it is desirable to have convenient access to ironing supplies and accessories (60, 61 are exemplary only and may include spray starch, distilled water bottles, and the like) during the ironing process and further while it is desirable to have those supplies and accessories conveniently stored on the ironing board 10 itself, the normal practice of folding and storing the ironing board between uses requires that a caddy 20 for storing the supplies and accessories must either be a foldable part of the ironing board itself or must be removable for separate storage.

The ironing board 10 has at least one end 13 free of encumbrances so as to provide an acceptable place to attach the caddy 20. The caddy 20 is removably attached to the end 13 by a hanging member 30. The hanging member 30 is preferably a rigid wire loop having an opening sized to fit over the end 13 of the ironing board 10. The hanging member 30 comprises a top portion 31 which lies on the top surface 11 of the ironing board 10, a pair of side portions 32, and a pair of descending portions 33, all of which together form an open loop sized to receive the width and thickness of the end 13 of the ironing board 10.

Depending from the opening formed in the open loop defined by the two descending portions 33 of the hanging member 30 are a pair of downward extensions 34 which form the means for suspending a basket 40 for holding ironing supplies and accessories. The basket 40 is preferably formed substantially from a single wire form defining the open top, back, front, bottom, and two sides. The wire form defines the right and left top back edges 41, 42 which are attached to the downward extension 34, left and right top side edges 43, 44, left and right front side edges 45, 46, left and right bottom side edges 47, 48, and a back bottom edge 49. Desirably the top portion 31, pair of side portions 32, and pair of descending portions 33 of the hanging member 30, the downward extensions 34, and the right and left top back edges 41, 42, left and right top side edges 43, 44, left and right front side edges 45, 46, left and right bottom side edges 47, 48, and back bottom edge 49 of the basket 40 are formed as a single continuous loop of rigid wire.

To complete the basket 40, bottom struts 50 between the left and right bottom side edges 47, 48 define a bottom for supporting ironing supplies and accessories 60, 61 therein, and front struts 51 between the left and right front side edges 45, 46 prevent the supplies and accessories 60, 61 from falling forward.

The ironing board caddy 20 of the present invention is preferably constructed of plastic coated rigid wire for durability and aesthetic appeal.

As noted above, after use ironing boards are normally folded and stored. It is therefore necessary to remove and store the caddy 20 and the ironing supplies and accessories 60, 61 as well. There is therefor the problem of both carrying the loaded caddy 20 and storing the caddy 20 between uses. The present invention solves both these problems by providing for a hanging member 30 which also serves as a carrying handle for moving the caddy 20 between the ironing board and a storage place and as a hanger for storing the caddy 20 on a vertical surface such as a wall or door between uses.

The present invention has been described with reference to certain preferred and alternative embodiments which are considered exemplary only and not limiting to the full scope of the invention as set forth in the appended claims.

What is claimed is:

1. An ironing board caddy for the convenient storage of ironing supplies and accessories on an ironing board of the type having an essentially flat top surface, a bottom surface, and at least one end of defined width and thickness, comprising:

a hanging member having an opening sized to receive the defined width and thickness of the end of the ironing board whereby said hanging member is adapted to hanging the caddy from the end of the ironing board, to manually carrying the caddy, and to hanging the caddy from a vertical surface for storage when not used in combination with the ironing board;

a basket for receiving the ironing supplies and accessories; and suspension means for suspending said basket from said hanging member, said suspension means suspending said basket under the end of the ironing board when the caddy is attached to the ironing board.

2. The ironing board caddy of claim 1 wherein said hanging member comprises a rigid wire loop.

3. The ironing board caddy of claim 2 wherein said rigid wire loop is an open loop defining a downward opening at the bottom surface of the ironing board and said suspension means comprises a pair of downward extensions of said downward opening of said rigid wire loop.

4. The ironing board caddy of claim 3 wherein said basket has an open top for receiving the ironing supplies and accessories, a back, a front, a bottom, and two sides, and further wherein said open top, said back, said front, said bottom, and said two sides are formed by a single wire form defining a top back edge, left and right top side edges, left and right front side edges, left and right bottom side edges, and a back bottom edge.

5. The ironing board caddy of claim 4 wherein said top back edge of said wire form has an opening aligned with and attached to said downward extensions whereby said hanging member, said downward extensions, and said wire form of said basket form a continuous wire loop.

6. The ironing board caddy of claim 5 wherein said bottom of said basket further comprises a plurality of bottom struts between said left and right bottom side edges.

7. The ironing board caddy of claim 6 wherein said front of said basket further comprises a plurality of front struts between said left and right front side edges.

8. The ironing board caddy of claim 7 wherein said continuous wire loop comprises plastic coated wire.

* * * * *